US005711599A

United States Patent [19]

Teng

[11] Patent Number: 5,711,599

[45] Date of Patent: Jan. 27, 1998

[54] LAMPSHADE

[76] Inventor: Chih-chen Teng, 4th Fl., No. 41, Lane 286, Sec. 1, Chienkwo S. Rd., Taipei, Taiwan

[21] Appl. No.: 563,967

[22] Filed: Nov. 29, 1995

[51] Int. Cl.[6] ..... F21V 1/06

[52] U.S. Cl. ..... 362/352; 362/358; 362/444

[58] Field of Search ..... 362/352, 358, 362/434, 444

[56] References Cited

U.S. PATENT DOCUMENTS

| | | | |
|---|---|---|---|
| 3,742,210 | 6/1973 | Chapman | 362/358 |
| 4,714,987 | 12/1987 | Dene | 362/352 |
| 5,375,048 | 12/1994 | Barnes | 362/352 |

*Primary Examiner*—Stephen F. Husar

*Attorney, Agent, or Firm*—Watson Cole Stevens Davis, P.L.L.C.

[57] ABSTRACT

A lampshade consists of a foldable frame, a shade attached on the frame, and a mounting fitting detachably fitted with the frame. The mounting fitting is formed by bending a steel wire to have an upper portion consisting of a pair of laterally extending ears and a pair of vertical extending portions, a lower portion consisting a pair of pear-shaped gripping portions. The upper portion is used to engage with the frame, and the lower portion is used to engage with an incandescent bulb of a lamp so that the lampshade can be mounted onto the lamp.

12 Claims, 6 Drawing Sheets

F

LAMPSHADE

FIELD OF THE INVENTION

The present invention is related to a lampshade, particularly to a lampshade for a table or mini lamp. Also, the present invention is related to a lamp incorporating such a lampshade.

BACKGROUND OF THE INVENTION

The lampshade of a conventional table or mini lamp always is unfoldable and has a fixed structure so that it occupies a large space when the lamp is stored or transported. Furthermore, the conventional lampshade needs to cooperate with additional fittings, i.e., a finial and a harp, so that it can be mounted onto the lamp. Such additional fittings cause the lamp to have a relatively complicated structure and high cost. Finally, it is not convenient to attach/detach the conventional lampshade onto/from the lamp.

The present invention is disclosed to afford an improved lampshade which can mitigate and/or obviate the above-mentioned problems concerning the conventional lampshade.

SUMMARY OF THE INVENTION

It is an objective of the present invention to provide a lampshade which can be very conveniently attached/detached onto/from a table or mini lamp.

A further objective of the present invention is to provide a lampshade which is foldable.

It is a further objective of the present invention to provide a lampshade which can be directly mounted onto the incandescent bulb of a lamp so that the lamp can obviate the necessity of a finial and a harp.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
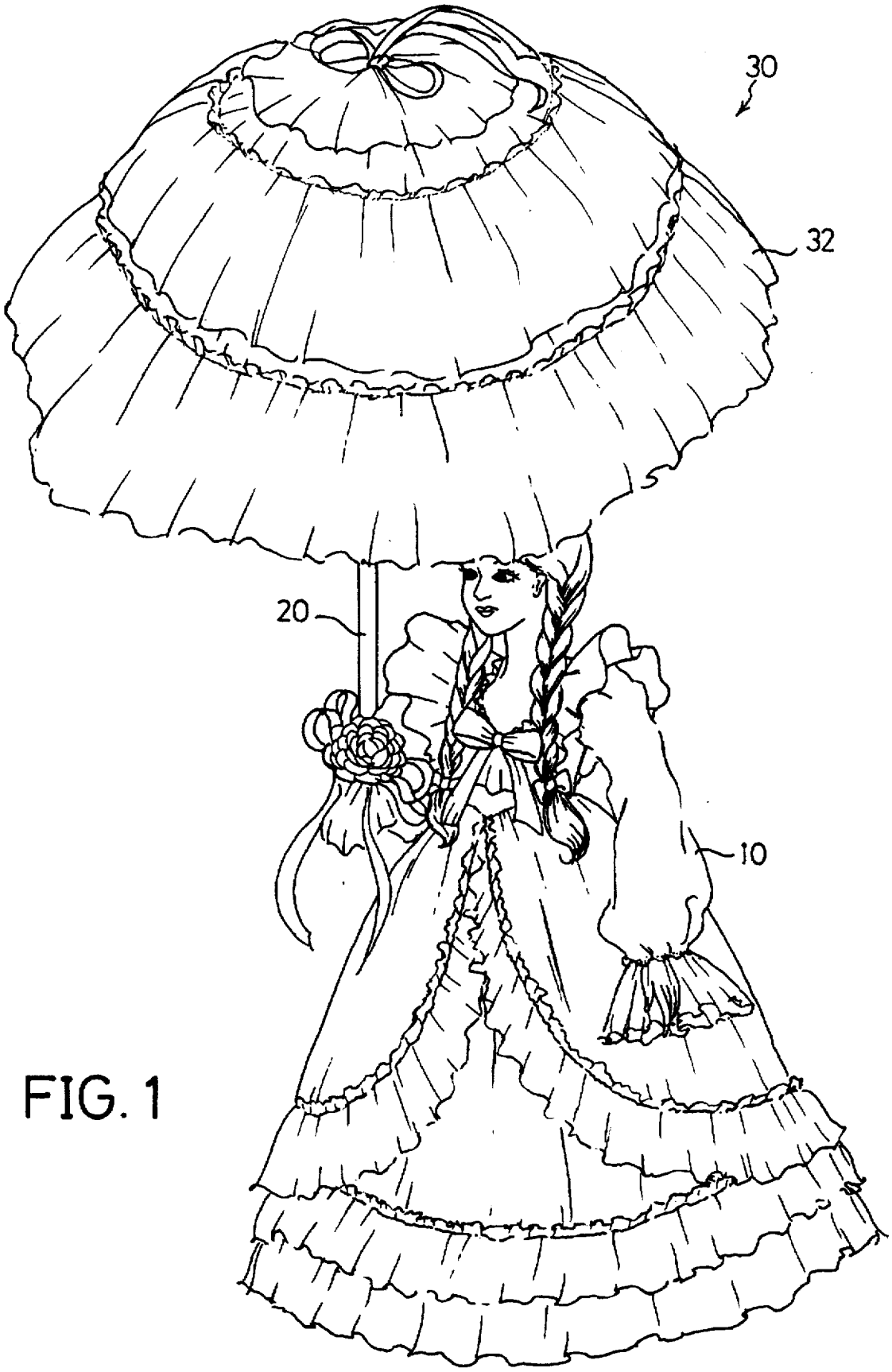
FIG. 1 is a perspective view showing that a preferred embodiment of a lamp in accordance with the present invention.
Figure 2:
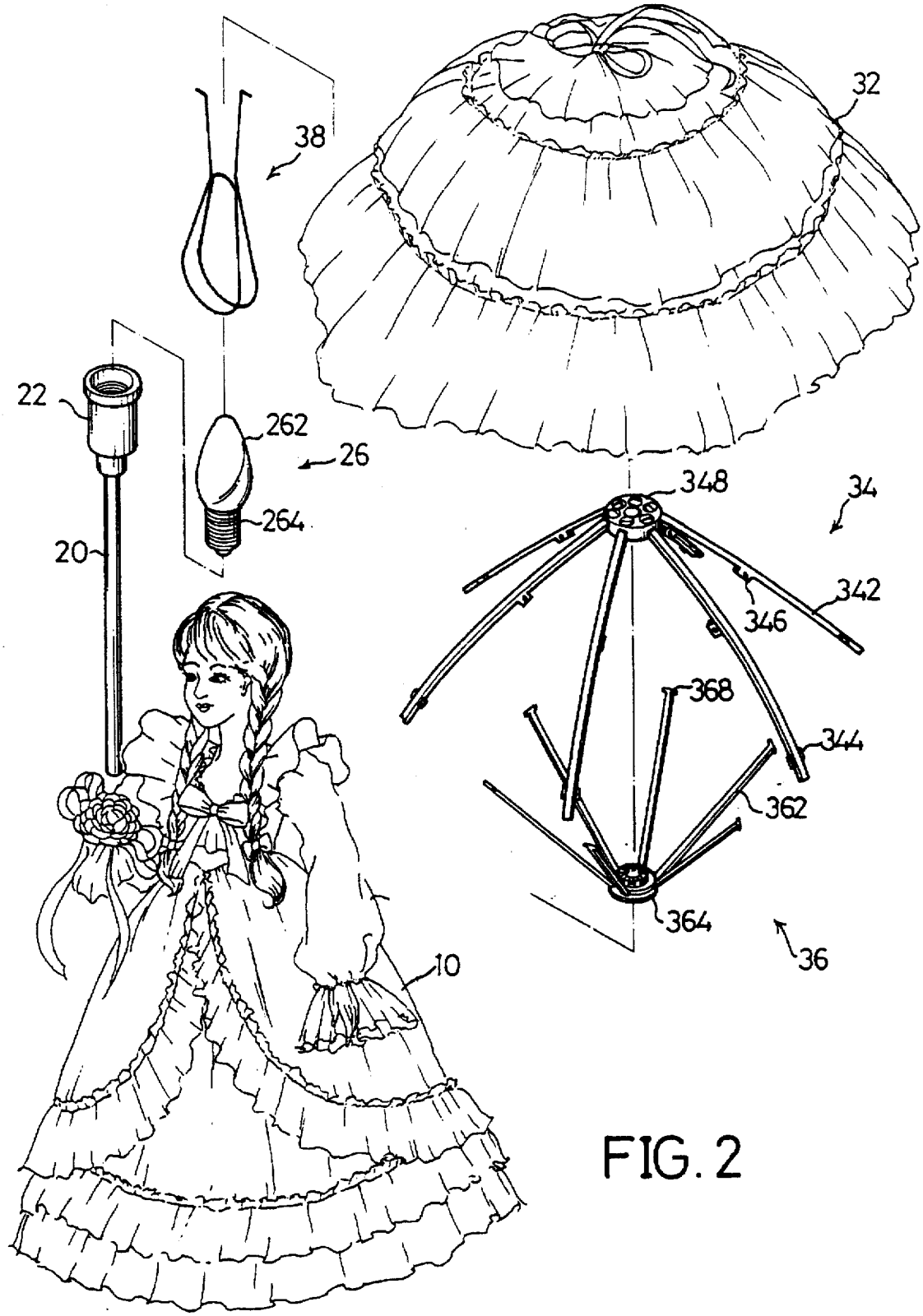
FIG. 2 is an exploded view of FIG. 1.

Referring to FIGS. 1 and 2, the present lampshade which is generally indicated by reference number 30 is mounted on a rod 20 attached to a lamp seat 10 generally having a doll configuration.

A socket 22 is formed on a top of the rod 20 wherein the socket 22 is used to threadedly engage with an electrical contacting portion 264 of an incandescent bulb 26 so that electrical power can be provided to the incandescent bulb 26. The incandescent bulb 26 is provided with a bulb 262 above the electrical contacting portion 264.

The present lampshade 30 consists mainly of a shade 32 formed by cloth, a frame composed by an upper frame 34 and a lower frame 36, both of the upper and lower frames being formed by plastic molding, and a mounting fitting 38 formed by a bending of a steel wire.

The upper frame 34 consists of an inside cap 348 and a plurality of ribs 342 radially extending from the inside cap 348. Each rib 342 is formed to have a joint 346 positioned generally at an intermediate portion thereof and a tip 344 positioned generally at an end distal from the inside cap 348. The ribs 342 are pivotable a certain degree relative to the inside cap 348.

The shade 32 is attached on the upper frame 34 by a know means, for example, a circumferential edge of the shade 32 being stitched together with the tips 344 of ribs 342.

Figure 5:
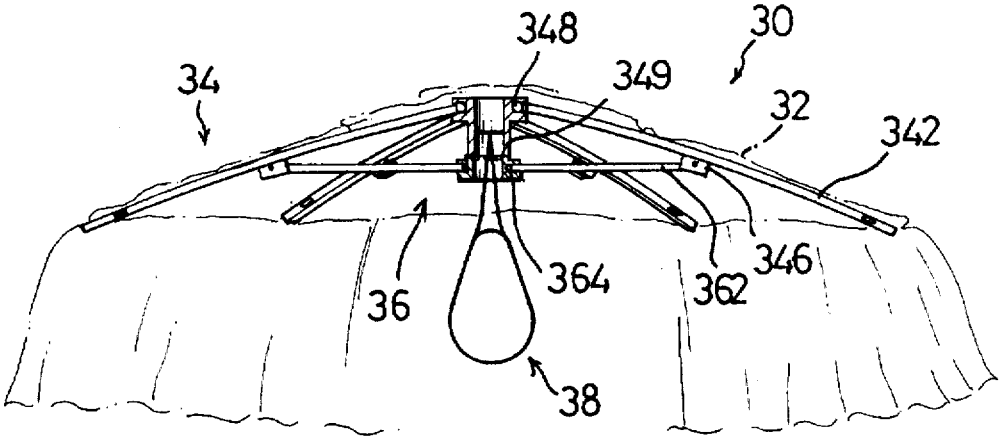
FIG. 5 is a view similar to FIG. 4 but showing that the frame together with the shade is extended and the mounting fitting is being mounted onto the frame.
Figure 4:
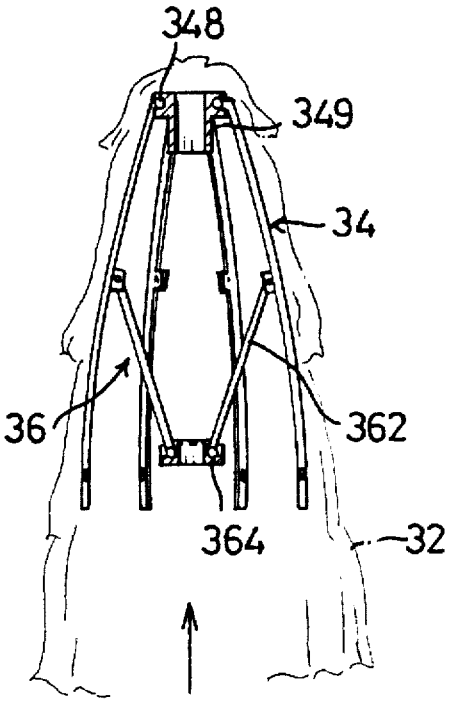
FIG. 4 is a front, cross-sectional view showing a frame together with a shade of the lampshade in a collapsed state.

The lower frame 36 is formed to have a runner 364 and a plurality of stretchers 362 radially extending from the runner 364. Each stretcher 362 is formed to have a pin 368 at an end distal from the runner 364. When the lower frame 36 is assembled with the upper frame 34 to form the frame for the lampshade 30, the pins 368 are pivotably connected with the joints 346 so that the frame can be collapsed to have a construction like that as shown in FIG. 4 or extended to have a construction like that as shown in FIG. 5.

The mounting fitting 38 has an upper portion which is used to be fitted into the frame and a lower portion which is used to be engaged with the bulb 262 of the incandescent bulb 26 (better seen in FIG. 6) thereby to mount the lampshade 30 onto the lamp.

Figure 3B:
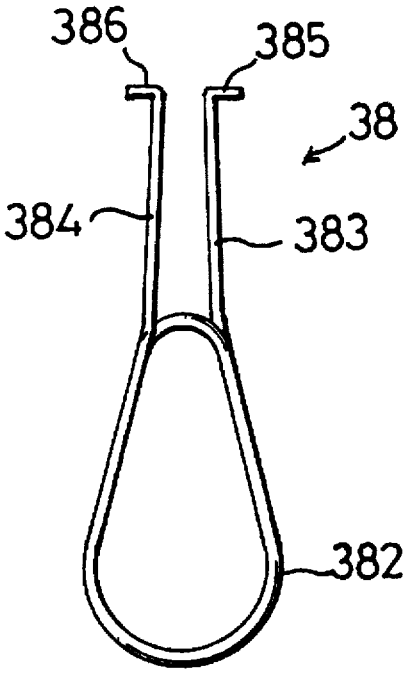
FIG. 3B is a front elevational view of FIG. 3A.
Figure 3C:
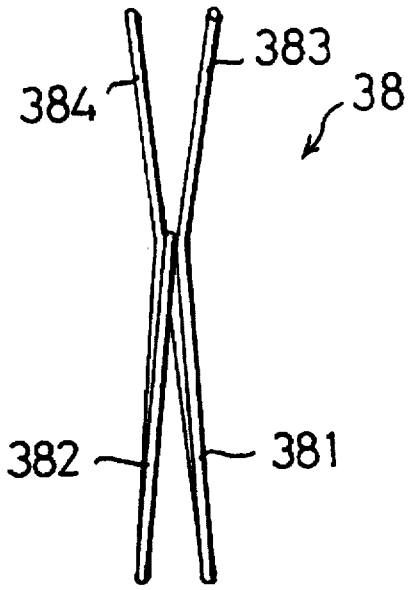
FIG. 3C is a side elevational view of FIG. 3A.
Figure 3A:
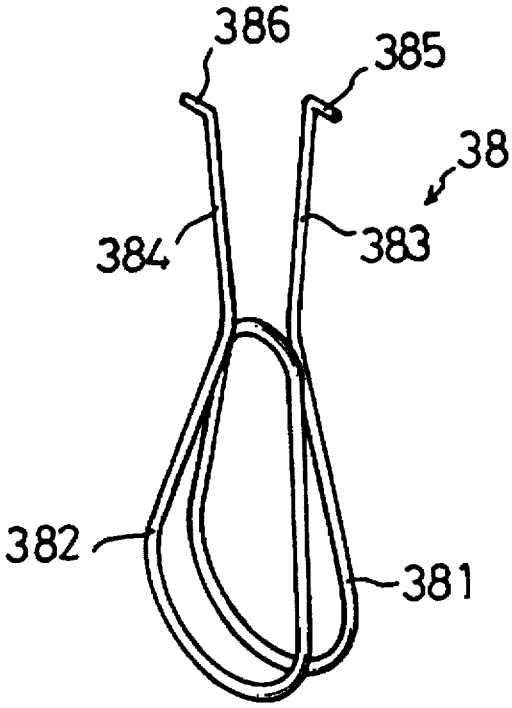
FIG. 3A is a perspective view in an enlarged scale showing a mounting fitting of a lampshade in accordance with the present invention.

FIGS. 3A to 3C show the details of the mounting fitting 38. The mounting fitting 38 is formed by bending a steel wire which has a good nature of resilience. The mounting fitting 38 is bent to have an upper portion which consists of a pair of laterally extending ears 385 and 386 and a pair of generally vertically extending portions 383 and 384, and a lower portion consists of a pair of gripping portions 381 and 382 generally having a pear-shaped configuration.

Particularly referring to FIG. 3B, due to the resilience of the steel wire forming the mounting fitting 38, a force can be exerted to push the vertically extending portions 383 and 384 toward each other so that the ears 386 and 386 can contact (or be very close) with each other, thereby the upper portion of the mounting fitting 38 can be fitted into the frame, which will be more detailedly disclosed in the future.

Furthermore, particularly referring to FIG. 3C, a force can be exerted to pull the gripping portions 381 and 382 away from each other thereby permitting the bulb 262 of the incandescent bulb 26 to be inserted into and located between the two gripping portions 381 and 382 in which the two gripping portions 381 and 382 will exert a gripping force on the bulb 362 so that the mounting fitting 38 can be fixedly engaged with the incandescent bulb 36.

Now refer to FIGS. 4 to 5 which show how the lampshade is assembled and how the lampshade is mounted onto the lamp.

When stored or transported, the frame with the shade 32 is under a collapsed state as shown in FIG. 4, and the frame is separated from the mounting fitting 38. When a user wants to assemble the lampshade 30, first he (she) must exert a force as indicated by F in FIG. 4 to push the runner 364 toward the inside cap 348 until the runner 364 is blocked by a bottom edge of a sleeve 349 which is integrally extended downwardly from the inside cap 348 as shown by FIG. 5. At this position, since the stretchers 362 are generally horizontally extended and the cloth of the shade 32 is fully stretched to exert forces having equal magnitude but in opposite directions on each pair of the stretchers 362 through a corresponding pair of the ribs 342 and the joints 346 so that the frame can reach a balanced state and be fixed at this position.

Then, the user uses his thumb and a finger to pinch the vertical extending portion 383 and 384 to cause the ears 385 and 386 to contact (or be very close) with each other and insert the upper portion of the mounting fitting 38 into the sleeve 349 through the runner 364 as shown in FIG. 5.

Figure 6:
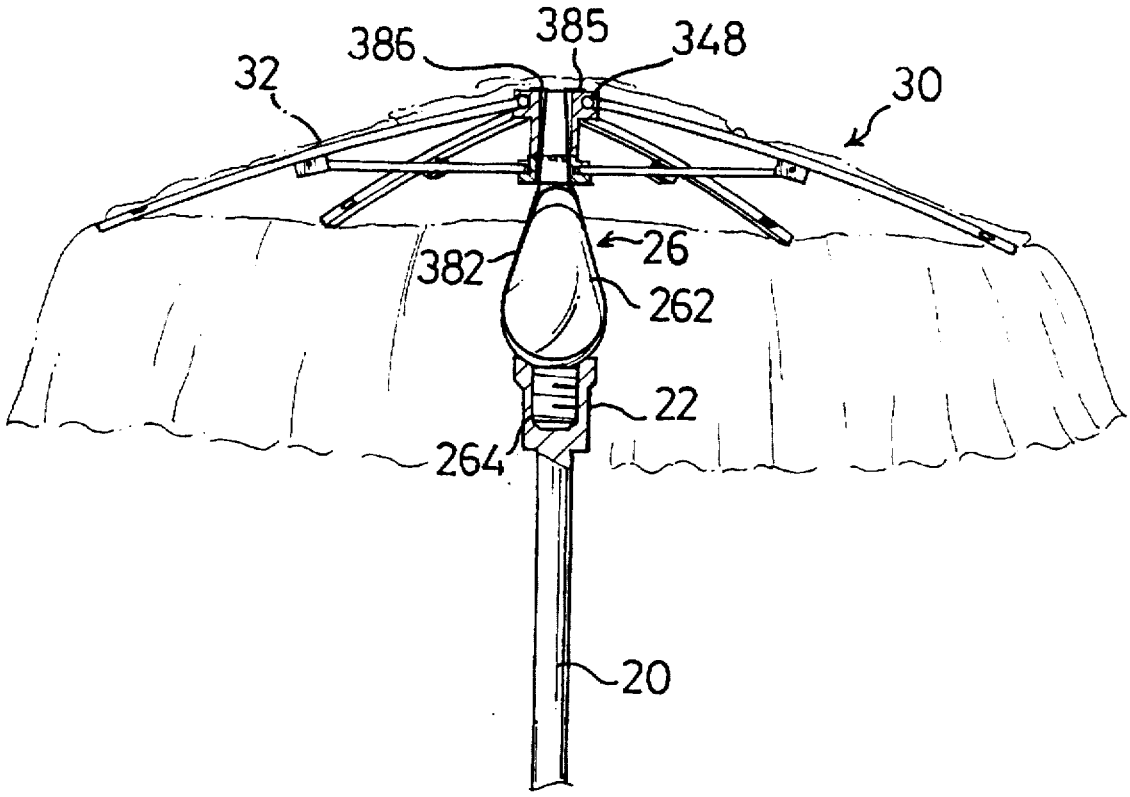
FIG. 6 is a view similar to FIG. 5 but showing that the mounting fitting has been mounted onto the frame and connects the frame and a bulb of the lamp together.

The upper portion of the mounting fitting 38 is inserted into the sleeve 349 until the ears 385, 386 are located between the shade 32 and a top edge of the inside cap 348. At this moment, the user releases his (her) thumb and finger which are exerting a pinch force on the vertical extending portions 383, 384 whereby the ears 385, 386 can engage the top edge of the inside cap 348 so that the mounting fitting 38 is fixedly engaged with the frame as shown in FIG. 6.

Figure 7:
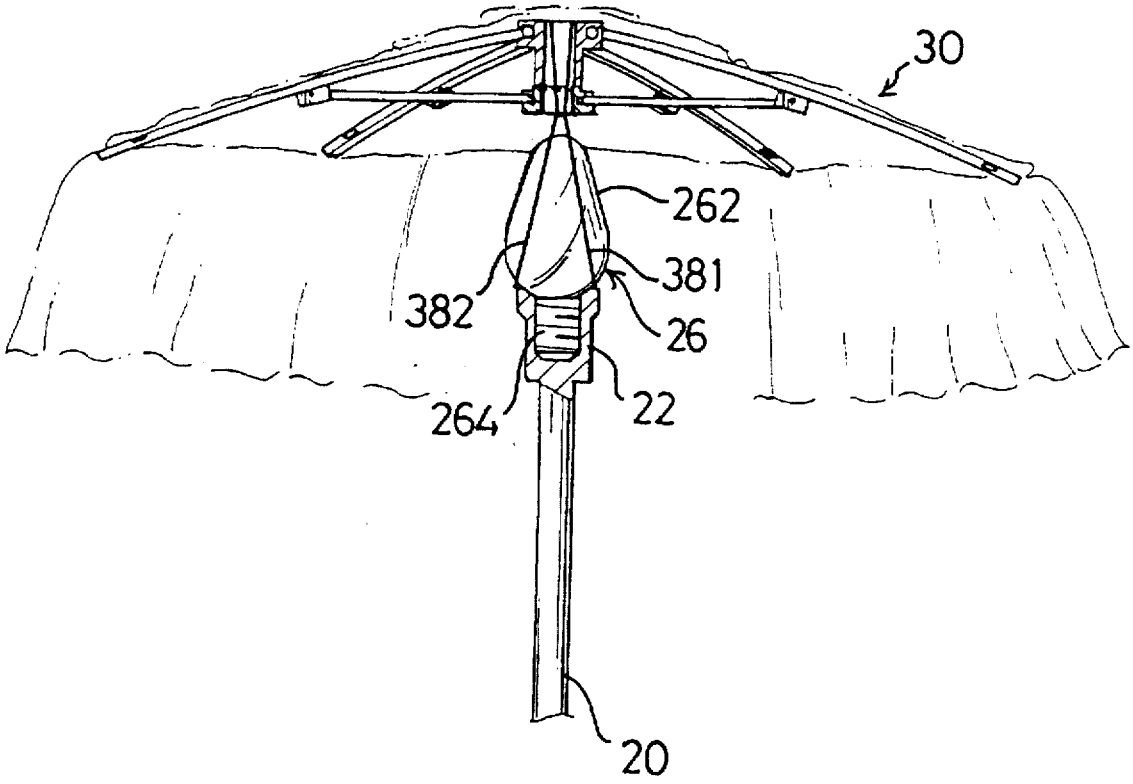
FIG. 7 is a view similar to FIG. 6 but with the direction of viewing being rotated about 90°.

After the mounting fitting 38 is assembled with the frame to form a complete lampshade 30, the user can use his (her) hands to engage the lower portion of the mounting fitting 38 with the incandescent bulb 26 wherein the gripping portions 381 and 382 are positioned on two sides (better seen in FIG. 7) of the bulb 262 and exert a gripping force thereon. FIG. 7 is view obtained by rotating FIG. 6 about 90° whereby the relationship among the mounting fitting 38, the incandescent bulb 26, and the frame can be more better understood. As shown in FIGS. 6 and 7, the incandescent bulb 26 has already been mounted on the top of the rod 20 by threadedly engaging the electrical contacting portion 264 of the incandescent bulb 26 with the socket 22.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lampshade, comprising:

a foldable frame having a foldable upper frame: and a foldable lower frame pivotably connected with the upper frame;

a shade being attached on the upper frame; and a resilient mounting fitting detachably fitted on the frame, having an upper portion engaged with the frame and a lower portion adapted to be engaged with an incandescent bulb of a lamp.

2. A lampshade according to claim 1, wherein the upper frame comprises an inside cap and a plurality of ribs radially and pivotably extending from the inside cap, each rib being formed to have a joint, and the lower frame comprises a runner and a plurality of stretchers radially and pivotably extending from the runner, each stretcher having an end which is distal from the runner, being pivotably connected with a corresponding joint of a corresponding rib.

3. A lampshade according to claim 2, wherein the upper portion further comprises a sleeve integrally extending downwardly from the inside cap, said runner being in contact with a bottom edge of the sleeve and the stretchers being substantially horizontally extended.

4. A lampshade according to claim 1 wherein said upper frame comprises an inside cap, a sleeve integrally extending downwardly from the inside cap and a plurality of ribs radially and pivotably extending from the inside cap, the lower frame comprising a runner and a plurality of stretchers radially and pivotably extending from the runner, each stretcher being pivotably connected with a corresponding rib, and wherein said upper portion of the mounting fitting is extended through the runner, the sleeve and the inside cap so that the laterally extending ears are located between a top edge of the inside cap and the shade and engaged with the top edge of the inside cap.

5. A lamp, comprising:

a lamp seat;

a rod extending upward from the seat and defining a socket at a top end thereof;

an incandescent bulb having a bulb and an electrical contacting portion received in the socket; and a lampshade, comprising:

a foldable frame;

a shade attached on the frame; and a resilient mounting fitting detachably fitted on the frame, having an upper portion engaged with the frame and a lower portion engaged with the bulb of the incandescent bulb.

6. A lamp according to claim 5, wherein the upper portion of the mounting fitting is configured to have a pair of laterally extending ears and a pair of substantially vertically extending portions, and the lower portion is configured to have a pair of pear-shaped gripping portions engaging two sides of the bulb and exerting a gripping force thereon.

7. A lamp according to claim 3, wherein the mounting fitting is formed by bending a steel wire.

8. A lamp according to claim 5, wherein the frame comprises a foldable upper frame and a foldable lower frame pivotably connected with the upper frame, said shade being attached on the upper frame.

9. A lamp according to claim 8, wherein the upper frame comprises an inside cap and a plurality of ribs radially and pivotably extending from the inside cap, each rib being formed to have a joint, and the lower frame comprises a runner and a plurality of stretchers radially and pivotably extending from the runner, each stretcher having an end which is distal from the runner, being pivotably connected with a corresponding joint of a corresponding rib.

10. A lamp according to claim 9, wherein the upper portion further comprises a sleeve integrally extending downwardly from the inside cap, said runner being in contact with a bottom edge of the sleeve and the stretchers being substantially horizontally extended.

11. A lamp according to claim 7 wherein said frame comprises a foldable upper frame and a foldable lower frame pivotably connected with the upper frame, said shade being attached on the upper frame, said upper frame comprising an inside cap, a sleeve integrally extending downward form the inside cap and a plurality of ribs radially and pivotably extending from the inside cap, the lower frame comprising a runner and a plurality of stretchers radially and pivotably extending from the runner, each stretcher being pivotably connected with a corresponding rib, and wherein said upper portion of the mounting fitting is extended through the runner, the sleeve and the inside cap so that the laterally extending ears are located between a top edge of the inside cap and the shade and engaged with the top edge of the inside cap.

12. A lamp according to claim 5, wherein the lamp seat has a doll-like configuration.

* * * * *